United States Patent [19]

McGrath et al.

[11] 4,087,086

[45] May 2, 1978

[54] TENSION CLAMP

[76] Inventors: Lindsay Thomas McGrath, 89 Sydney Street, Muswellbrook, N.S.W., Australia, 2333; Gilbert Thomas McGrath, 14 Farrington Close, Caves Beach, N.S.W., Australia

[21] Appl. No.: 830,401

[22] Filed: Sep. 6, 1977

[30] Foreign Application Priority Data

Sep. 6, 1976 Australia ..... 7273/76

[51] Int. Cl.[2] ..... B25B 5/12

[52] U.S. Cl. ..... 269/212

[58] Field of Search ..... 269/212–215, 269/228

[56] References Cited

U.S. PATENT DOCUMENTS 828,113 8/1906 Hillebrandt ..... 269/215

FOREIGN PATENT DOCUMENTS 463,958 2/1973 Australia ..... 269/212

*Primary Examiner*—Robert C. Watson

*Attorney, Agent, or Firm*—Hamilton, Renner & Kenner

[57] ABSTRACT

A tension clamp includes, in combination, a main jaw co-extensive with an elongated adjusting arm, a movable jaw co-extensive with a hollow housing through which the adjusting arm is adapted to pass freely, a tension lever pivotally attached to and between two side cheeks of the housing, a secondary level pivotally fastened at one end thereof to the tension lever, the other end of the secondary lever being constrained with respect to the housing by means of a pin in sliding relationship with respect to a pair of registering travelling slots, each formed within a respective one of the side cheeks of the housing, the pin being adapted to engage selectively one of a number of semicircular notches formed within an edge of the adjusting arm remote from the main jaw, and the pair of travelling slots being adapted to guide sliding movement of the pin therealong from a first position wherein the pin is free of engagement with the notches to a second position wherein the pin engages one of the notches. Pivotal movement of the tension lever with respect to the housing initially causes the pin to slide along the pair of travelling slots from its first position to its second position whereby free sliding motion of the adjusting arm within the housing is prevented by the engagement of the pin in the one notch, and then causes the housing to lock securely with respect to the adjusting arm by an over-center action to grip firmly within the jaws any workpiece located therebetween.

4 Claims, 5 Drawing Figures

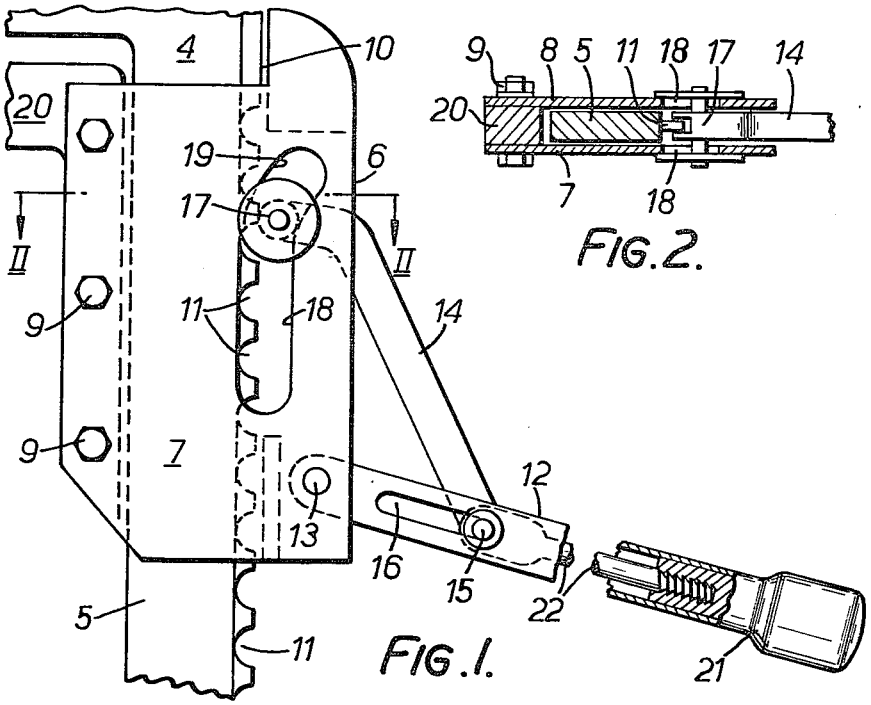
FIG. 1.
FIG. 2.
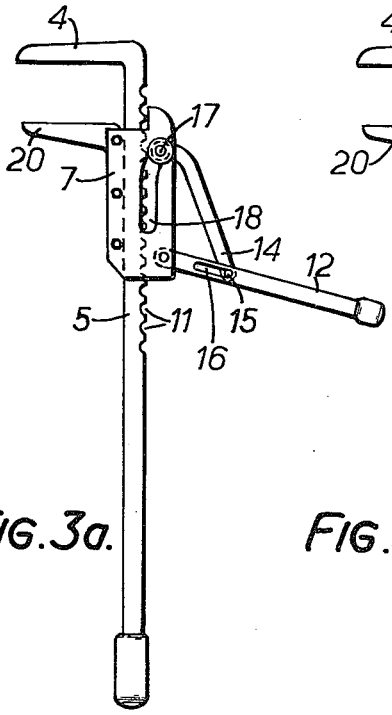
FIG. 3a.
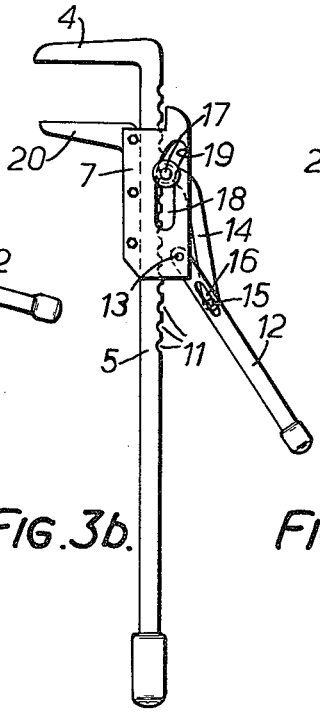
FIG. 3b.
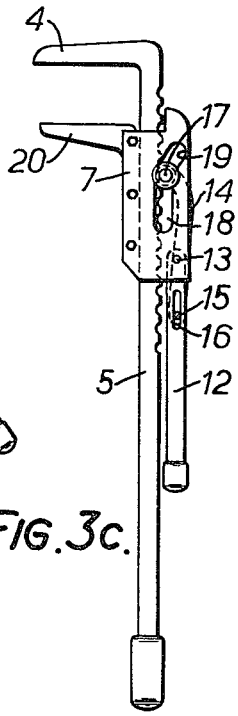
FIG. 3c.

TENSION CLAMP

BACKGROUND OF THE INVENTION

This invention relates to improvements in tension clamps.

In our Australian Patent Specification No. 463,958, there is disclosed a tension clamp which comprises, in combination, a main jaw co-extensive with an elongated adjusting arm, a movable jaw co-extensive with a hollow housing through which said adjusting arm is adapted to pass freely, an adjustable tension lever pivotally attached to and between two side cheeks of said housing, a secondary lever pivotally fastened at one end thereof to said tension lever by a swivel pin adapted for adjustable location within a travelling slot formed in said tension lever, the other end of said secondary lever being constrained with respect to said housing by means of an eccentric cam set in sliding relationship with respect to a further pair of registering travelling slots, each formed within a respective one of said side cheeks of said housing, said cam being adapted to engage selectively one of a number of semi-circular notches formed within an edge of said adjusting arm remote from said main jaw, an operating handle being provided upon said cam and protruding to the exterior of said housing, whereby a sliding motion of said adjusting arm within said housing is permitted following an arcuate adjustment of said handle in one sense and prevented by the locking of said cam in one or other of said notches following an arcuate movement of said handle in the opposite sense, and whereby a rotary movement of said tension lever with respect to said housing causes the latter then to lock securely with respect to said adjusting arm by an overcenter action to grip firmly within said jaws any workpiece located therebetween.

In use of such a tension clamp, however, it has been found that the necessity to often manipulate both the workpiece to be clamped, and the clamp itself, which in many industrial applications may be quite large and heavy, makes simplification of the operation of the clamp desirable. In particular, in use of the clamp disclosed in Australian Patent Specification No. 463958, it is not only necessary for the operator to adjust the position of the housing relative to the adjusting arm so as to roughly position the jaws of the clamp about the workpiece and to pivotally move the tension lever with respect to the housing, but in addition the operator must operate the operating handle provided on the eccentric cam and protruding to the exterior of the housing when the jaws of the clamp have been roughly positioned.

SUMMARY OF THE INVENTION

It is an object of the present invention to provide an improved tension clamp having simplified operation, and in particular to provide an improved tension clamp of the type disclosed in Australian Patent Specification No. 463,958 wherein the need for separate operation of an operating handle is avoided.

According to the present invention therefore, there is provided an improved tension clamp which includes, in combination, a main jaw co-extensive with an elongated adjusting arm, a movable jaw co-extensive with a hollow housing through which said adjusting arm is adapted to pass freely, a tension lever pivotally attached to and between two side cheeks of said housing, a secondary lever pivotally fastened at one end thereof to said tension lever, the other end of said secondary lever being constrained with respect to said housing by means of a pin in sliding relationship with respect to a pair of registering travelling slots, each formed within a respective one of said side cheeks of said housing, said pin being adapted to engage selectively one of a number of semi-circular notches formed within an edge of said adjusting arm remote from said main jaw, and said pair of travelling slots being adapted to guide sliding movement of said pin therealong from a first position wherein said pin is free of engagement with said notches to a second position wherein said pin engages said one of said notches, whereby pivotal movement of said tension lever with respect to said housing initially causes said pin to slide along said pair of travelling slots from said first position to said second position whereby free sliding motion of said adjusting arm within said housing is prevented by the engagement of said pin in said notch, and then causes said housing to lock securely with respect to said adjusting arm by an over-center action to grip firmly within said jaws any workpiece located therebetween.

Preferably, each of the pair of travelling slots is arcuate at the end thereof corresponding to said first position of said pin. Preferably also, the secondary lever is pivotally fastened to the tension lever by a swivel pin adapted for adjustable location within a travelling slot formed in the tension lever. Such adjustable location may be provided by means of a rotatable handle on said tension lever in threaded engagement with an adjusting member extending longitudinally of said tension lever from said handle to the swivel pin, whereby rotation of said handle will cause said adjusting member to slide said swivel pin in said travelling slot.

Further features of the present invention will be apparent from the following description, given by way of example only, of a preferred embodiment of the invention.

BRIEF DESCRIPTION OF THE DRAWINGS

FIG. 1 shows, in side elevation, a detailed view of the operating mechanism of the preferred embodiment of the present invention;

FIG. 2 shows, partly in section, a plan view along the line 2—2 of FIG. 1; and, FIGS. 3A, 3B and 3C show, in side elevation, the preferred embodiment of the present invention at different stages in the operation thereof.

DESCRIPTION OF THE PREFERRED EMBODIMENT

Upon referring to the drawings it will be seen that the clamp according to the present invention includes a main jaw 4 which is co-extensive with an adjusting arm 5 lying approximately at right angles thereto. The arm 5 is slidably movable within the hollow housing 6, which includes side cheeks 7 and 8, fastened together and to movable jaw 20 by bolts, as at 9. The back edge 10 of the arm 5 is provided with a series of semicircular notches such as 11, equally spaced therealong.

A tension lever 12 is pivotally attached via a pivot 13 to the housing 6 between the side cheeks 7 and 8. A secondary lever 14 is attached at its lower end to the tension lever 12 via the swivel pin 15, which is adapted to slide within the travelling slot 16. Secondary lever 14 is attached at its upper end to a sliding pin 17 which is capable of sliding relationship with the travelling slot 18 in the cheek 7, and also with a similar registering slot in the opposite cheek 8. The pin 17 may also engage selectively one or the other of said semicircular slots 11 in the back edge 10 of the arm 5. The configuration of travelling slot 18 constitutes an important aspect of the present invention. As shown, these slots include an arcuate portion 19 which curves away from the adjusting arm 5 and guides sliding pin 17 toward and away from the notches 11 in the back edge 10 of the arm 5 as the pin is moved back and forth along the slot 18 by pivotal movement of the tension lever 12 and by virtue of the linkage which secondary lever 14 makes between the tension lever 12 and the pin 17. When tension lever 12 is pivoted upward as shown in FIG. 1, pin 17 is moved into arcuate portion 19 of the slot 18 and out of engagement with notches 11 in the arm 5. This operating position of the clamp is illustrated in FIG. 3A. In this position, the housing and adjustable arm are freely slidable relative to each other to enable the jaws 4 and 20 to be set with respect to a workpiece.

Upon downward pivotal movement of the tension lever 12 from the position of FIG. 3A, pin 17 is slid downwardly along the slot 18 until it engages one of the notches 11 in the arm 5. This operating position is illustrated in FIG. 3B. In this position, the housing is no longer freely slidable relative to the arm 5 because of this engagement of the pin 17 in one of the notches 11. Upon pivoting the tension lever 12 further downward into the lock position shown in FIG. 3C, wherein said lever is substantially parallel with the adjusting arm 5, the over-center action provided by the pivot 13 together with the secondary lever 14, the swivel pin 15 and the sliding pin 17, causes the jaws 4 and 20 to grip the workpiece tightly.

Should the tension on the lever 12 be too great to allow it to be pulled down to the lock position the tension lever may be rotated upward again to the position shown in FIG. 3B, whereupon the handle 21 of the lever may be rotated about its longitudinal axis to vary the position of the swivel pin 15 along the length of the travelling slot 16 by advancing or retracting adjusting member 22 which is in treaded engagement with handle 21 and extends between the handle and swivel pin 15. Thus, upon again depressing the tension lever 12 into the position shown in FIG. 3C, the locking position may be assumed again whereby the workpiece is firmly held. Alternatively, if initially the depression of the tension lever 12 provides too little gripping force between the jaws 4 and 20 despite the selection of the best available notch 11 by the pin 17, an appropriate rotation of the handle of said tension lever about its longitudinal axis in the opposite sense will adjust the arc described by swivel pin 15, so as to correspondingly increase the force necessary to cause said lever to pass beyond the overcenter position into the locking position above described.

The entire clamp may be constructed from any suitable durable material such as mild steel, tool steel or the like, and may have a large range of sizes.

While one particular embodiment of the present invention has been described herein, it will be appreciated that this is described by way of example only and that many modifications and variations may be made thereto without departing from the spirit and scope of the present invention.

We claim:

1. A tension clamp comprising, in combination, a main jaw co-extensive with an elongated adjusting arm, a movable jaw co-extensive with a hollow housing through which said adjusting arm is adapted to pass freely, a tension lever pivotally attached to and between two side cheeks of said housing, a secondary lever pivotally fastened at one end thereof to said tension lever, the other end of said secondary lever being constrained with respect to said housing by means of a pin in sliding relationship with respect to a pair of registering travelling slots, each formed within a respective one of said side cheeks of said housing, said pin being adapted to engage selectively one of a number of semi-circular notches formed within an edge of said adjusting arm remote from said main jaw, and said pair of travelling slots being adapted to guide sliding movement of said pin therealong from a first position wherein said pin is free of engagement with said notches to a second position wherein said pin engages said one of said notches, whereby pivotal movement of said tension lever with respect to said housing initially causes said pin to slide along said pair of travelling slots from said first position to said second position whereby free sliding motion of said adjusting arm within said housing is prevented by the engagement of said pin in said notch, and then causes said housing to lock securely with respect to said adjusting arm by an over-center action to grip firmly within said jaws any workpiece located therebetween.

2. A tension clamp as claimed in claim 1, wherein each of said travelling slots is arcuate at the end thereof corresponding to said first position of said pin.

3. A tension clamp as claimed in claim 1, wherein said secondary lever is pivotally fastened to said tension lever by a swivel pin adapted for adjustable location within a travelling slot formed in the tension lever.

4. A tension clamp as claimed in claim 3, wherein said adjustable location of said swivel pin is provided by means of a rotatable handle on said tension lever in threaded engagement with an adjusting member extending iongitudinally of said tension lever from said handle to said swivel pin, whereby rotation of said handle will cause said adjusting member to slide said swivel pin in said travelling slot formed in the tension lever.

* * * * *